United States Patent [19]

Seidensticker

[11] Patent Number: 4,856,431

[45] Date of Patent: Aug. 15, 1989

[54] DEVICE FOR ARMING AND DISARMING A DIRECTIONAL MINE

[75] Inventor: Jens Seidensticker, Kaarst, Fed. Rep. of Germany

[73] Assignee: Rheinmetall GmbH, Düsseldorf, Fed. Rep. of Germany

[21] Appl. No.: 176,867

[22] Filed: Apr. 1, 1988

[30] Foreign Application Priority Data

Apr. 2, 1987 [DE] Fed. Rep. of Germany ..... 3711166

[51] Int. Cl.[4] ..... F42B 23/26; F42C 15/14

[52] U.S. Cl. ..... 102/427; 102/401

[58] Field of Search ..... 102/401, 424, 426, 427

[56] References Cited

U.S. PATENT DOCUMENTS 3,908,553 9/1975 Beach ..... 102/254
4,702,169 10/1987 Gallant ..... 102/401
4,712,478 12/1987 Haglund et al. ..... 102/424

FOREIGN PATENT DOCUMENTS 2423912 11/1975 Fed. Rep. of Germany .
3025280 1/1982 Fed. Rep. of Germany ..... 102/427
3304373 8/1984 Fed. Rep. of Germany .
3343086 6/1985 Fed. Rep. of Germany .
2551198 3/1985 France ..... 102/426
2563001 10/1985 France .

*Primary Examiner*—Charles T. Jordan
*Attorney, Agent, or Firm*—Spencer & Frank

[57] ABSTRACT

A directional mine for combatting armored vehicles includes a projectile having a propelling device and a warhead; a support structure positioning the projectile prior to launching the projectile therefrom and electric circuitry for serving the projectile. There is further provided an arming unit including a battery, and an igniter accommodated in a housing insertable into and removable from the support structure; an ejector for pushing the housing out of the support structure; a locking device for retaining the housing in the inserted position and for preventing the ejector from becoming effective; a timer for placing the locking device in a releasing state after a predetermined period for allowing the ejector to push the housing outwardly; and electrical contacts mounted in the support structure and on the housing. Respective contacts are in engagement with one another in the inserted position of the housing.

10 Claims, 2 Drawing Sheets

DEVICE FOR ARMING AND DISARMING A DIRECTIONAL MINE

BACKGROUND OF THE INVENTION

The present invention relates to a directional mine, particularly mines for combatting armored vehicles, and is of the type that is ejected from a carrier projectile or set up in the field and is guided by a targeting device which includes sensors. The mine further has an igniter or detonator for a projectile equipped with a warhead and a battery for supplying the electric circuits with current.

Directional mines which are dropped from a carrier projectile or set up in the field, are provided with an igniter which is customarily integrated in the rocket engine of the mine or in the detonator behind the warhead. A battery which is required for current supply is also integrated in the system. Since it cannot be externally determined whether the mine is activated (armed) or not, special safety measures must be taken when handling these mines. Deactivating (disarming) these mines also poses significant problems. For example, in the mine disclosed in German Pat. No. 3,343,086, the deactivation is effected by self-detonation of the mine.

SUMMARY OF THE INVENTION

It is an object of the present invention to provide a directional mine of the above-mentioned type which may be activated and deactivated in a simple manner.

A further object of the present invention is to provide a readily identifiable external indication as to whether the directional mine is in the activated or deactivated state.

These objects and others to become apparent as the specification progresses, are accomplished by the invention, according to which, briefly stated, the directional mine for combatting armored vehicles includes a projectile having a propelling device and a warhead; a support structure positioning the projectile prior to launching the projectile therefrom and electric circuitry for serving the projectile. There is further provided an arming unit including a battery, and an igniter accommodated in a housing insertable into and removable from the support structure; an ejector for pushing the housing out of the support structure; a locking device for retaining the housing in the inserted position and for preventing the ejector from becoming effective; a timer for placing the locking device in a releasing state after a predetermined period for allowing the ejector to push the housing outwardly; and electrical contacts mounted in the support structure and on the housing. Respective contacts are in engagement with one another in the inserted position of the housing.

Due to the fact that the firing unit is simply inserted into the directional mine to activate it and is locked therein, and after the given period of time is ejected to deactivate the mine if no target was attacked, easy detection of whether the mine is in the activated or deactivated state is made possible, and special training of operating personnel is not necessary. Additionally, by providing a separate external housing it is easy and practical to exchange the battery and program the time and target settings before insertion of the housing and activation of the mine. Also, the mine may be placed in readiness in the field without its igniting unit.

DESCRIPTION OF THE PREFERRED EMBODIMENT

Figure 1:
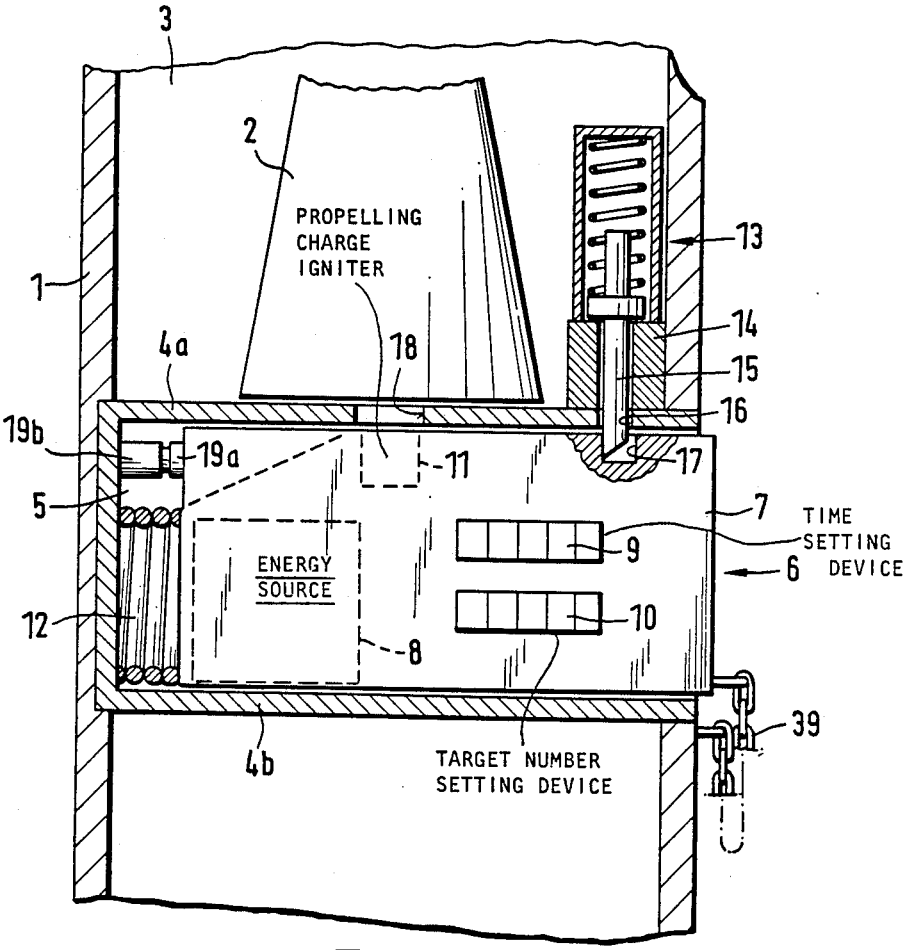
FIG. 1 is a fragmentary sectional view of a directional mine incorporating a preferred embodiment according to the invention.

The directional mine as illustrated in FIG. 1, includes a mounted firing tube 1 which can be set up in the field and which receives in a receiving chamber 3, a projectile, which is automatically armed when launched. The projectile may be a rocket, of which only the nozzle 2 of the rocket engine is shown. Below the receiving chamber 3 for the rocket, there is a receiving chamber 5 for a firing unit 6. The receiving chamber 5 is defined within the firing tube 1 by an upper partition **4*a* and a lower partition 4*b*, with one lateral side of the receiving chamber remaining open. The receiving chamber 5 may be formed by a rectangular box-shaped housing which has one open side and which is inserted into the firing tube 1**.

The firing unit 6 includes a housing 7 which accommodates a battery 8, a time setting device 9, a target number setting device 10 and a propelling charge igniter 11 for firing the rocket engine. The time setting device 9 and the target number setting device 10 are readily accessible on the side of the housing 7 and can be easily set prior to insertion of the housing 7 into the receiving chamber 5.

On the rear side of receiving chamber 5, opposite the lateral opening, there is disposed an ejection spring 12 which is compressed by the housing 7 as the latter is inserted into the receiving chamber 5.

A locking device 13 serves to lock housing 7 in the receiving chamber 5. The locking device 13 is composed of an electromagnet 14 and an armature constituted by a blocking pin 15 which extends through an opening 16 in the upper partition **4*a* of the receiving chamber 5. The blocking pin 15 is spring biased in a direction toward the receiving chamber 5. The upper side of housing 7 is provided with a recess 17 into which the blocing pin 15 extends when the housing 7 is sufficiently inserted into the receiving chamber 5 against the force of ejection spring 12. To facilitate insertion of housing 7 into the receiving chamber 5, the housing 7 and the blocking pin 15 may be slightly chamfered. By virtue of this arrangement an incorrect insertion of the housing 7** into the receiving chamber is not possible.

When the housing is properly inserted into the receiving chamber 5 and locked therein by the blocking pin 15, the propelling charge igniter 11 is disposed directly below a central opening 18 in the upper partition **4*a* and thus directly below the nozzle 2** of the rocket engine.

The housing 7 is provided with housing contacts **19*a* which can be brought into engagement with corresponding terminals 19*b* of the directional mine by insertion and locking of the housing 7 in the receiving chamber 5. Terminals 19*b* are connected to conductors (not shown) which provide electrical current for the electrical circuits shown in FIG. 2 between firing unit 6 and an aiming device 20 as well as a securing device 21 for the directional mine. The contacts 19*b* are preferably disposed in the region of the receiving chamber 5 opposite the lateral opening, while housing contacts 19*a* are provided on the frontal face of the housing, when seen in the direction of insertion. Contacts 19***a* and 19*b* are plug-in contacts and associated sockets for simple connection and disconnection of the housing 7.

Figure 2:
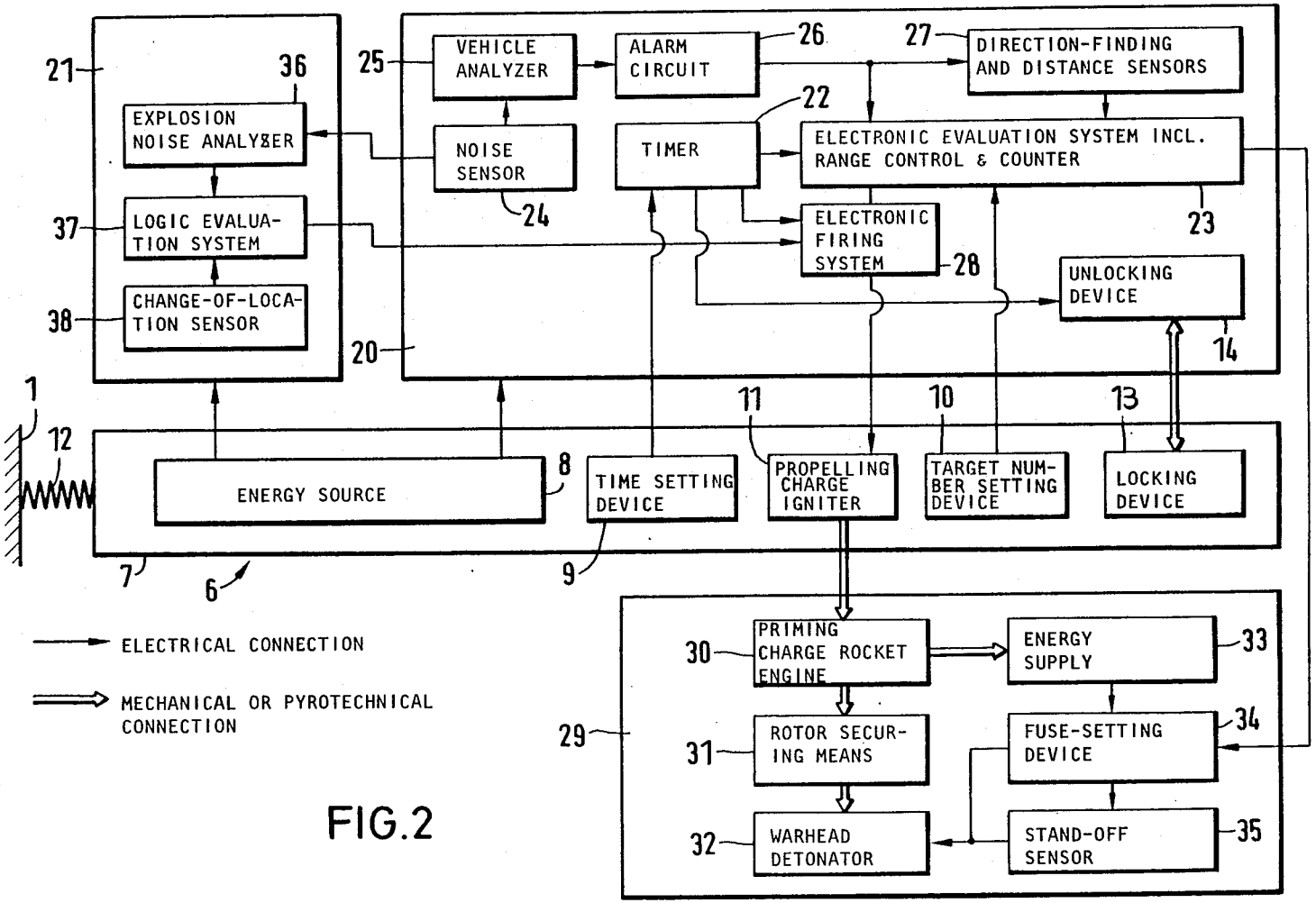
FIG. 2 is a block diagram of the electrical, mechanical and pyrotechnical connections in the directional mine of FIG. 1.

As shown in FIG. 2, the battery 8 serves as the energy source for aiming device 20. The aiming device 20 is equipped with a timer 22 comprising an electronic circuit which is activated by virtue of the energization of the aiming device 20 by the battery 8 upon insertion and locking of the housing 7 in the receiving chamber 5. The time setting device 9 sets the period of operation of the timer 22. The timer 22 controls the electromagnet 14 which, at the end of the time set by the time setting device 9, energizes the electromagnet 14, thus retracting locking pin 15 from recess 17 so that the ejectio spring 12 can eject the housing 7 from the receiving chamber 5.

The timer 22 is also connected to an electronic evaluation system 23 having a range control and counter. The target number setting device 10 indicates to the electronic evaluation system 23 the first, second, third and other targets to be attacked.

The aiming device 20 further includes a noise sensor 24 which is connected with a circuit 25 for analyzing vehicles. The circuit 25 controls an alarm circuit 26 which actuates the electronic evaluation system 23 and direction-finding and distance sensors 27. The signals of the direction-finding and distance sensors 27 are also fed to the electronic evaluation system 23.

The electronic evaluation system 23 controls an electronic firing system 28 which fires the propelling charge igniter 11. The latter is pyrotechnically connected with the active portion 29 of the rocket. A priming charge 30, in the form of a rocket engine, is pyrotechnically connected with a rotor securing means 31, a warhead detonator 32 and an energy supply 33 for the active portion 29. The active portion 29 also includes a fuse-setting device 34 controlled by the electronic evaluation system 23 and is powered by energy supply 33. The fuse-setting device 34 is coupled with the warhead detonator 32 and with a stand-off sensor 35, whose output signal is also applied to the warhead detonator 32.

The securing means 21 receives a signal from noise sensor 24 which is applied to an explosion noise analyzer 36 whose output signal is, in turn, applied to a logic evaluation system 37. The logic evaluation system 37 also receives signals from a change of location sensor 38. The system evaluates these signals and generates a control signal for the electronic firing system 28. If the signal sent by the logic evaluation system 37 coincides with a firing signal from the electronic evaluation system 23, firing is initiated by the electronic firing system 28. The energy supply for the securing means 21 is also provided by the battery 8.

After setting up the directional mine, the firing unit 6 is inserted into receiving chamber 5 to activate the mine. Before the insertion of the firing unit 6, the time setting device 9 is programmed with the predetermined time setting and the target number is programmed into the target number setting device 10. When the housing 7 fully engages the receiving chamber 5, the directional mine is activated and the battery 8 begins to supply the mine with energy, and thus the timer 22 begins to run. After approximately five minutes—which allows the person setting up the mine time to move away—the directional mine becomes fully activated. At the end of the predetermined time period set by the time setting device 9, and assuming that no target was attacked, the timer 22 actuates the electromagnet 14 and ejects the firing unit 6 thereby deactivating the directional mine. The ejected firing unit 6 remains attached to the firing tube 1 by a restraining chain 39 and may hang therefrom, thereby indicating to the operating personnel (possibly by appropriate color contrast from the tube 1) that the directional mine is disarmed.

The locking device 13 may alternatively be accommodated in the housing 7, in which case the blocking pin 15 drops into the opening 16 from the housing 7 when the latter has been properly inserted.

If desired, the electronic firing system 28 and/or the timer 22 may also be accommodated in the housing 7.

It will be understood that the above description of the present invention is susceptible to various modifications, changes and adaptations, and the same are intended to be comprehended within the meaning and range of equivalents of the appended claims.

What is claimed is:

1. In a directional mine for combatting armored vehicles, including a projectile having a propelling means and a warhead; a support structure positioning the projectile prior to launching the projectile therefrom; electric circuit means for serving the projectile; the improvement comprising (a) an arming unit including a battery, igniting means for firing the propelling means and a housing accommodating said battery and said igniting means, said housing being insertable into and removable from said support structure;

(b) ejecting means in engagement with said support structure and said housing for pushing said housing at least partially out of said support structure from an inserted position into an ejected position;

(c) locking means for retaining said housing in the inserted position and for preventing said ejecting means from becoming effective;

(d) timing means for placing said locking means in a releasing state after a predetermined period for allowing said ejecting means to push said housing outwardly of said support structure from said inserted position into said ejected position; and (e) first electrical contact means mounted in said support structure and forming part of said electric circuit means and second electrical contact means mounted on said housing and being electrically connected to said battery; said first and second electric contact means being in electric contact with one another in the inserted position of said housing.

2. A directional mine as defined in claim 1, wherein said locking means includes a spring-biased blocking pin mounted on said support structure and a recess for receiving said blocking pin provided on said housing.

3. A directional mine as defined in claim 2, wherein said locking means further includes an electromagnet operatively connected to said timing means for retracting said blocking pin to unlock said housing upon elapse of said predetermined period set by said timing means.

4. A directional mine as defined in claim 1, wherein said support structure further includes a means defining a receiving chamber for receiving said housing; said ejecting means comprising a spring situated in said chamber and being arranged to be compressed by said housing upon insertion thereof into said chamber.

5. A directional mine as defined in claim 4, wherein said receiving chamber includes an opening adjacent a rocket drive mechanism of the projectile, said opening comprising a pyrotechnical connection between said igniting means and said propelling means.

6. A directional mine as defined in claim 1, further including a chain attached to said housing and said support structure for retaining said housing when said housing is ejected from said inserted position.

7. A directional mine as defined in claim 1, wherein one of the first and second electrical contact means includes a plug-in contact and the other of said first and second electrical contact means includes a socket contact.

8. A directional mine as defined in claim 1, further including an aiming device and said arming unit including a target number setting means disposed in said housing for supplying the aiming device with a specified target number.

9. A directional mine as defined in claim 8, wherein the target number setting means is a counting circuit.

10. A direct mine as defined in claim 1, wherein the battery is exchangeably mounted in said housing.

* * * * *